US008664555B2

(12) United States Patent
Lee

(10) Patent No.: US 8,664,555 B2
(45) Date of Patent: Mar. 4, 2014

(54) TRIP BUTTON MECHANISM OF EXTERNAL HANDLE FOR CIRCUIT BREAKER

(75) Inventor: KwangWon Lee, Cheongju-si (KR)

(73) Assignee: LSIS Co., Ltd., Anyang-Si, Gyeonggi-do (KR)

( * ) Notice: Subject to any disclaimer, the term of this patent is extended or adjusted under 35 U.S.C. 154(b) by 247 days.

(21) Appl. No.: 13/252,133

(22) Filed: Oct. 3, 2011

(65) Prior Publication Data

US 2012/0080298 A1 Apr. 5, 2012

(30) Foreign Application Priority Data

Oct. 4, 2010 (KR) ..... 10-2010-0096507

(51) Int. Cl.
*H01H 9/02* (2006.01)

(52) U.S. Cl.
USPC ..... 200/332.1

(58) Field of Classification Search
USPC ..... 200/332.1, 43.01, 43.02, 43.11, 43.13, 200/43.16, 43.18, 330, 329, 293, 318.2, 200/333, 335, 341, 334
See application file for complete search history.

(56) References Cited

U.S. PATENT DOCUMENTS

| | | | |
|---|---|---|---|
| 4,982,173 | A | 1/1991 | Meiners et al. |
| 5,576,677 | A | 11/1996 | Malingowski et al. |
| 2012/0031745 | A1 | 2/2012 | Fischer |

FOREIGN PATENT DOCUMENTS

| | | |
|---|---|---|
| CZ | 300117 | 2/2009 |
| EP | 0688034 | 12/1995 |
| EP | 1492140 | 12/2004 |
| JP | 63-2352 | 1/1988 |
| JP | 11-306952 | 11/1999 |
| WO | 0116988 | 3/2001 |

OTHER PUBLICATIONS

Japan Patent Office Application Serial No. 2011-220268, Office Action dated Jan. 29, 2013, 2 pages.
European Patent Office Application Serial No. 11183775.3, Search Report dated Oct. 24, 2012, 21 pages.

*Primary Examiner* — Edwin A. Leon
*Assistant Examiner* — Anthony R. Jimenez
(74) *Attorney, Agent, or Firm* — Lee, Hong, Degerman, Kang & Waimey

(57) ABSTRACT

Provided is a trip button mechanism of an external handle for a circuit breaker. The trip button mechanism includes a button support, an externally operable trip button, and an elastic member. The button support is disposed at an outer casing of the externally operable handle and exposed through a penetration hole of the outer casing. The externally operable trip button includes a handle exposed through the penetration hole and a pusher in one piece with the handle. The pusher is movable along the button support for pushing a circuit breaker trip button. The elastic member applies a force to the externally operable trip button in a direction opposite to a direction in which the externally operable trip button pushes the circuit breaker trip button. Therefore, the trip button mechanism can be easily assembled to increase productivity and decrease manufacturing costs, and the trip button mechanism can be reliably operated.

15 Claims, 15 Drawing Sheets

TRIP BUTTON MECHANISM OF EXTERNAL HANDLE FOR CIRCUIT BREAKER

CROSS-REFERENCE TO RELATED APPLICATIONS

Pursuant to 35 U.S.C. 119(a), this application claims the benefit of earlier filing date and right of priority to Korean Patent Application No. 10-2010-00965074, filed on Oct. 4, 2010, the contents of which is hereby incorporated by reference in its entirety.

BACKGROUND

The present disclosure relates to a trip button mechanism of an external handle for a circuit breaker.

A circuit breaker may be disposed in a cabinet such as a switchboard cabinet. In this case, an externally operable handle may be attached to the outside of the cabinet to open or close the circuit breaker.

Hereinafter, a related-art trip button mechanism of an externally operable handle for a circuit breaker will be described with reference to the accompanying drawings.

FIG. 1 is a perspective view illustrating a circuit breaker (molded case circuit breaker) for three-phase alternating circuit according to the related art; FIG. 2 is a perspective view illustrating an externally operable handle assembly according to the related art; FIG. 3 is a perspective view illustrating an assembled state of the externally operable handle assembly according to the related art; FIG. 4 is a plan view illustrating the assembled state of the externally operable handle assembly according to the related art; FIG. 5 is a perspective view illustrating an assembly of a pushing plate, an elastic member, and a trip button that is assembled to an outer casing of the externally operable handle assembly according to the related art; FIG. 6 is a perspective view illustrating an assembled structure of the trip button of the externally operable handle according to the related art; FIG. 7 is an exploded perspective view for explaining a method for assembling the pushing plate, the elastic member, and the trip button according to the related art; and FIG. 8 is an enlarged view illustrating the pushing plate and a fitting protrusion according to the related art.

First, referring to FIG. 1, a circuit breaker 10 includes a casing 10*a* and a cover 10*b*. The casing 10*a* has a polyhedral shape with an opened side. Components of the circuit breaker 10 are disposed in the casing 10*a*. The cover 10*b* closes the opened side of the casing 10*a*.

A manipulation handle 12 is disposed on the cover 10*b* for opening or closing a circuit. The manipulation handle 12 can be manually manipulated. A circuit breaker trip button 11 is disposed on a side of the cover 10*b*. The circuit breaker trip button 11 is provided for forcibly tripping the circuit breaker 10. A pair of coupling screw holes 10*b*-1 is provided at each longitudinal end side of the cover 10*b* for coupling an externally operable handle assembly 20 (described later) to the cover 10*b*.

The externally operable handle assembly 20 includes an outer casing 23, an externally operable handle 22, and an externally operable trip button 30. The outer casing 23 forms the exterior of the externally operable handle assembly 20. The externally operable handle 22 is rotatably attached to a side of the outer casing 23. The externally operable trip button 30 is disposed in a side of the outer casing 23 in a manner such that the externally operable handle assembly 20 can be pushed. For example, the externally operable handle 22 may be connected to the manipulation handle 12 (refer to FIG. 1) through an interlocking device (not shown).

Referring to FIGS. 5 to 8, the externally operable trip button 30 may be connected to the circuit breaker trip button 11 (refer to FIG. 1) through components (described later). The circuit breaker 10 can be forcibly tripped from the outside of a cabinet such as a switchboard cabinet by using the externally operable trip button 30.

A pair of screw connection extensions 24 is provided on each longitudinal end surface of the outer casing 23. The screw connection extensions 24 protrude from both end surfaces of the outer casing 23 for coupling the outer casing 23 to the circuit breaker 10.

Referring to FIGS. 3 and 4, the outer casing 23 is fixed to the cover 10*b* by coupling screws to the screw connection extensions 24. The outer casing 23 is disposed in the switchboard cabinet (not shown) in a state where the externally operable handle 22 is exposed to the outside of the switchboard cabinet.

Hereinafter, a structure, an assembling method, and functions of the trip button mechanism of the externally operable handle 22 for the circuit breaker 10 will be described in more detail with reference to the accompanying drawings.

Referring to FIG. 7, the trip button mechanism of the externally operable handle 22 includes a button support 25, the externally operable trip button 30, a pushing plate 40, and an elastic member 50.

The button support 25 extends downward from the top surface of the outer casing 23. The pushing plate 40, the elastic member 50, and the externally operable trip button 30 are disposed in the button support 25. For this, the button support 25 includes: a cylindrical hole extension portion 26 having a circular cross section and extending downward from the top surface of the outer casing 23; and a slit extension portion 27 extending downward from the cylindrical hole extension portion 26. The slit extension portion 27 is narrower than the cylindrical hole extension portion 26 so that the externally operable trip button 30 cannot pass through the slit extension portion 27 but the pushing plate 40 can pass through the slit extension portion 27.

Referring to FIG. 6, the externally operable trip button 30 has an approximately cylindrical shape. A cross-shaped connection groove 31 is formed in the bottom surface of the externally operable trip button 30 for connection with the pushing plate 40.

Referring again to FIGS. 7 and 8, the pushing plate 40 may be formed of a thin plate insertable in the slit extension portion 27 of the button support 25. The pushing plate 40 includes an upper vertical plate portion 41, a middle oblique plate portion 42, and a lower hook portion 43.

The upper vertical plate portion 41 is inserted through the slit extension portion 27. A fitting protrusion 44 is provided on the upper end of the upper vertical plate portion 41. The fitting protrusion 44 is insertable in the connection groove 31 of the externally operable trip button 30. The middle oblique plate portion 42 extends from the lower end of the upper vertical plate portion 41 at a predetermined angle. The lower hook portion 43 extends downward from the lower end of the middle oblique plate portion 42. The circuit breaker trip button 11 is substantially manipulated by the lower hook portion 43. The elastic member 50 is disposed in the cylindrical hole extension portion 26. For example, the elastic member 50 may be a coil spring.

A method for assembling the trip button mechanism of the externally operable handle 22 for the circuit breaker 10 will now be described according to the related art.

First, the elastic member 50 is inserted in the cylindrical hole extension portion 26 extending downward from the top surface of the outer casing 23. Next, the externally operable trip button 30 is inserted down to the cylindrical hole extension portion 26. Next, the pushing plate 40 is moved upward to the slit extension portion 27 to insert the upper vertical plate portion 41 in the slit extension portion 27.

Then, the upper vertical plate portion 41 is inserted in the connection groove 31. In this way, the pushing plate 40, the elastic member 50, and the externally operable trip button 30 are assembled.

An operation of the trip button mechanism of the externally operable handle 22 for the circuit breaker 10 will now be described according to the related art.

In the related art, a user may push the externally operable trip button 30 to forcibly trip the circuit breaker 10 disposed in the switch cabinet by using the trip button mechanism of the externally operable handle 22. Then, the externally operable trip button 30 is moved downward against the resilience of the elastic member 50. As the externally operable trip button 30 is moved downward, the pushing plate 40 connected to the externally operable trip button 30 is also moved downward. Therefore, the lower hook portion 43 presses the circuit breaker trip button 11. Then, an internal opening/closing mechanism (not shown) of the circuit breaker 10 is switched to a trip position for interrupting a circuit.

However, as described above, the related-art trip button mechanism of the externally operable handle 22 for the circuit breaker 10 has the following limitations.

In the related art, when the trip button mechanism is assembled or used, the pushing plate 40 and the externally operable trip button 30 may be separated due to the resilience of the elastic member 50 disposed between the pushing plate 40 and the externally operable trip button 30.

Moreover, the externally operable handle 22 is constituted by many components such as the button support 25, the externally operable trip button 30, the pushing plate 40, and the elastic member 50. This may increase manufacturing costs and decrease assembling efficiency.

SUMMARY

Embodiments provide a trip button mechanism of an externally operable handle for a circuit breaker. The trip button mechanism has a simple structure so that the trip button mechanism can be easily assembled and reliably operated.

In one embodiment, there is provided a trip button mechanism of an externally operable handle for operating a circuit breaker trip button of a circuit breaker, the trip button mechanism including: a button support disposed at an outer casing of the externally operable handle, the button support being exposed through a penetration hole of the outer casing; an externally operable trip button including a handle exposed through the penetration hole and a pusher formed in one piece with the handle, the pusher being movable along the button support for selectively pushing the circuit breaker trip button; and an elastic member applying an elastic force to the externally operable trip button in a direction opposite to a direction in which the externally operable trip button pushes the circuit breaker trip button.

The details of one or more embodiments are set forth in the accompanying drawings and the description below. Other features will be apparent from the description and drawings, and from the claims.

DETAILED DESCRIPTION OF THE EMBODIMENTS

A trip button mechanism of an externally operable handle for a circuit breaker will now be described in detail according to exemplary embodiments with reference to the accompanying drawings.

Figure 9:
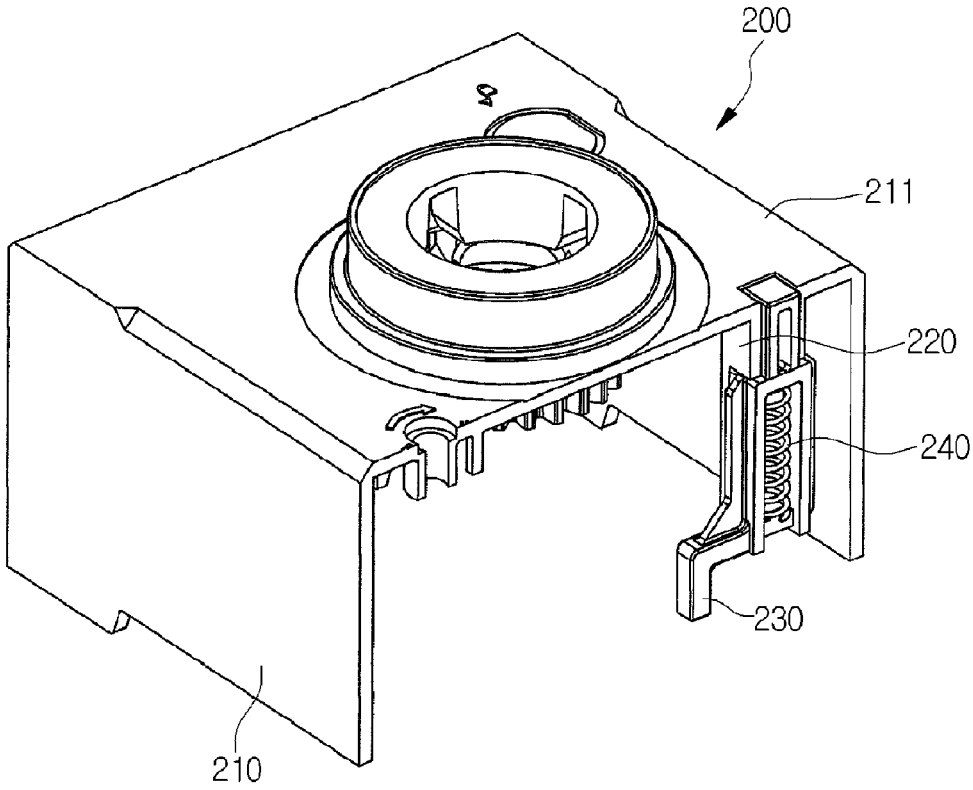
FIG. 9 is a perspective view illustrating an assembled state of a trip button mechanism of an externally operable handle for a circuit breaker according to an embodiment.
Figure 10:
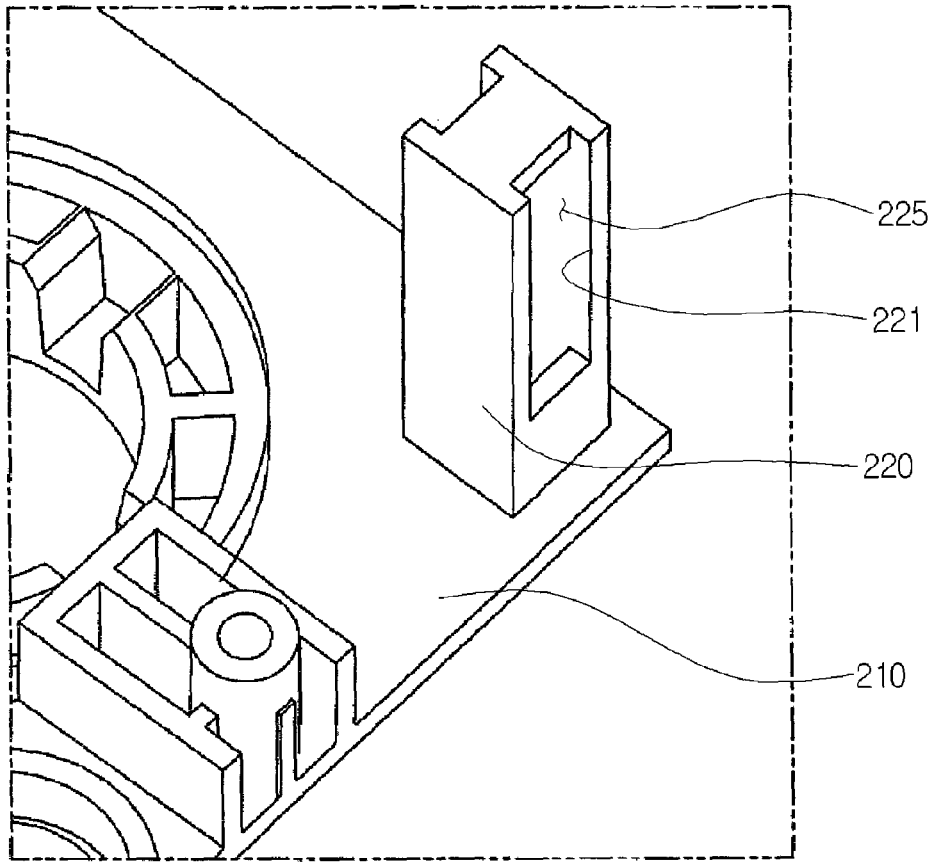
FIG. 10 is a bottom perspective view illustrating a main part of an outer casing according to an embodiment.
Figure 11:
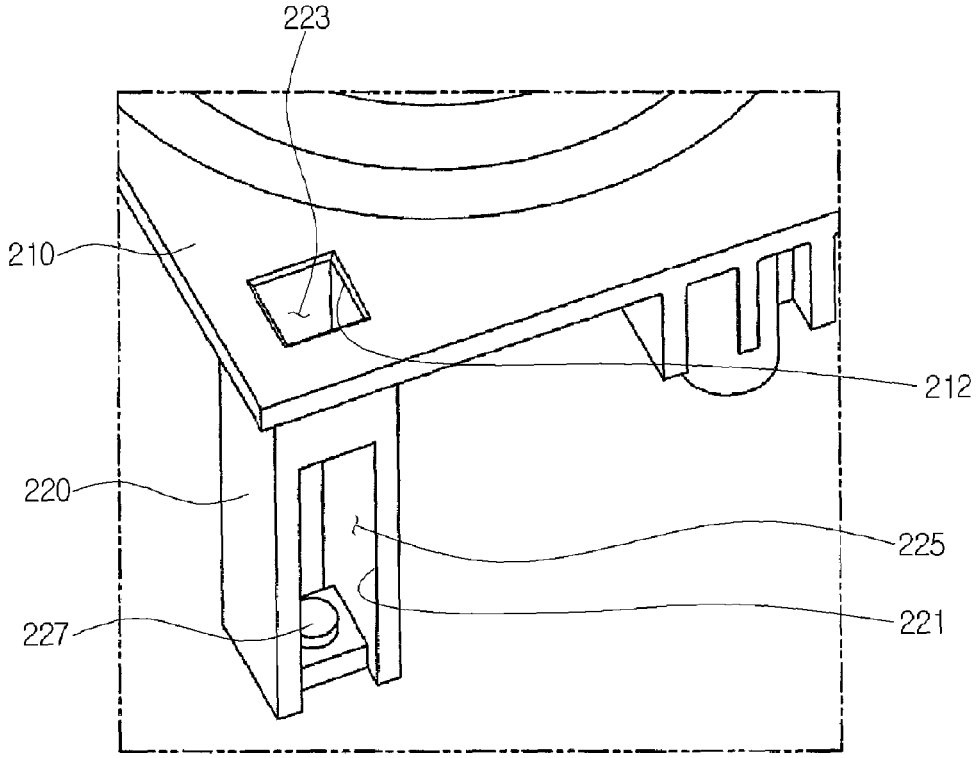
FIG. 11 is a perspective view illustrating the main part of the outer casing according to an embodiment.
Figure 12:
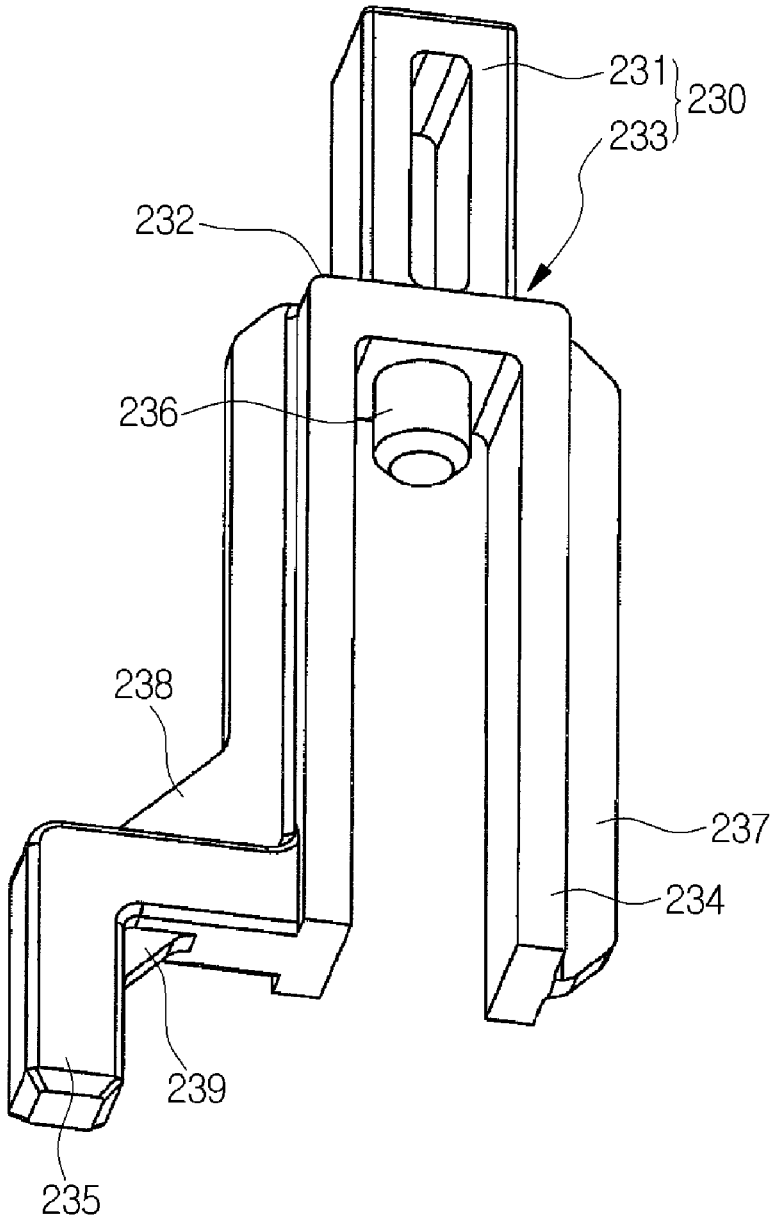
FIG. 12 is a perspective view illustrating an externally operable trip button according to an embodiment.

FIG. 9 is a perspective view illustrating an assembled state of a trip button mechanism of an externally operable handle for a circuit breaker according to an embodiment; FIG. 10 is a bottom perspective view illustrating a main part of an outer casing according to an embodiment; FIG. 11 is a perspective view illustrating the main part of the outer casing according to an embodiment; and FIG. 12 is a perspective view illustrating an externally operable trip button according to an embodiment.

Figure 1:
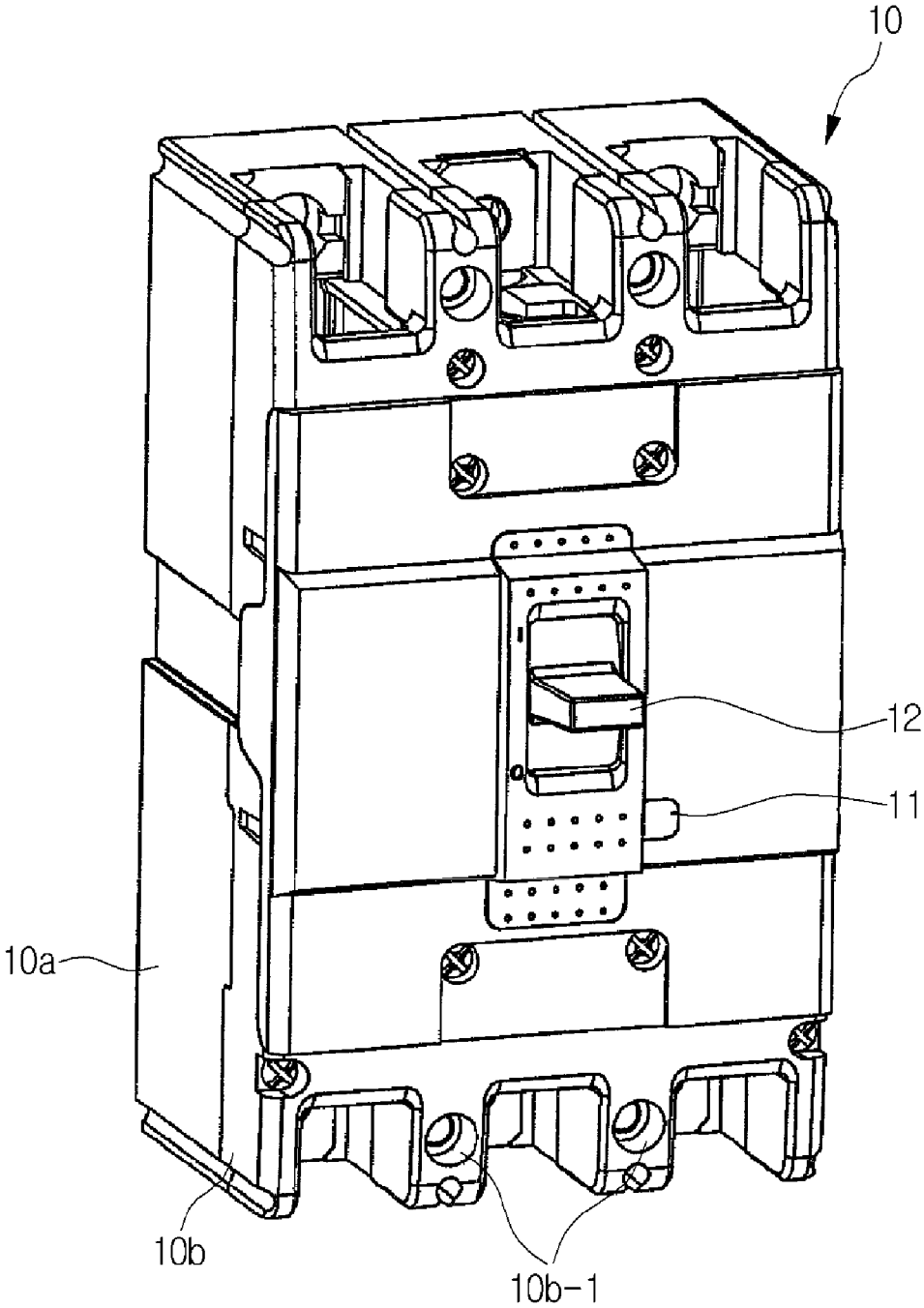
FIG. 1 is a perspective view illustrating a circuit breaker (molded case circuit breaker) for three-phase alternating circuit according to the related art.
Figure 2:
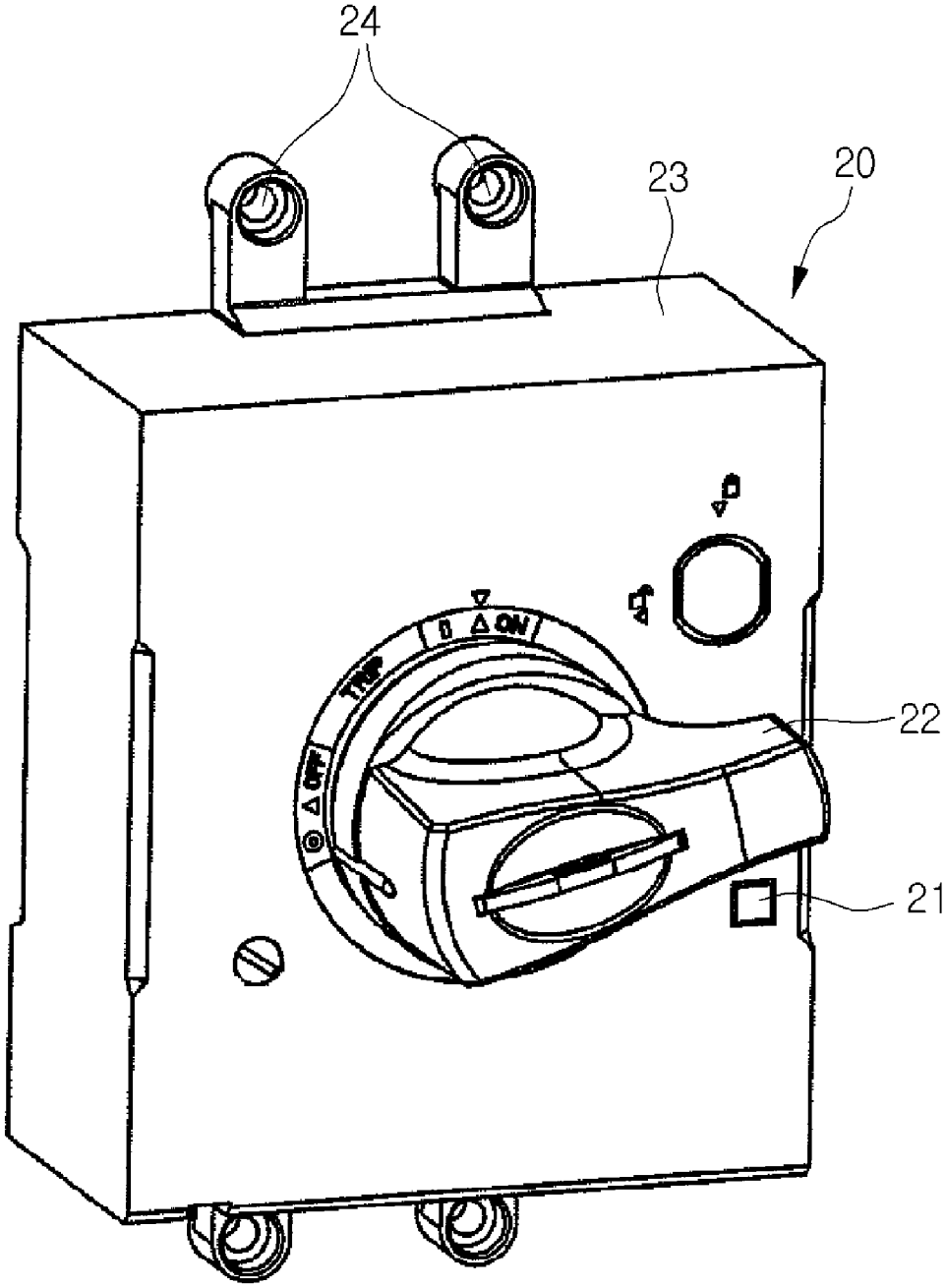
FIG. 2 is a perspective view illustrating an externally operable handle assembly according to the related art.
Figure 3:
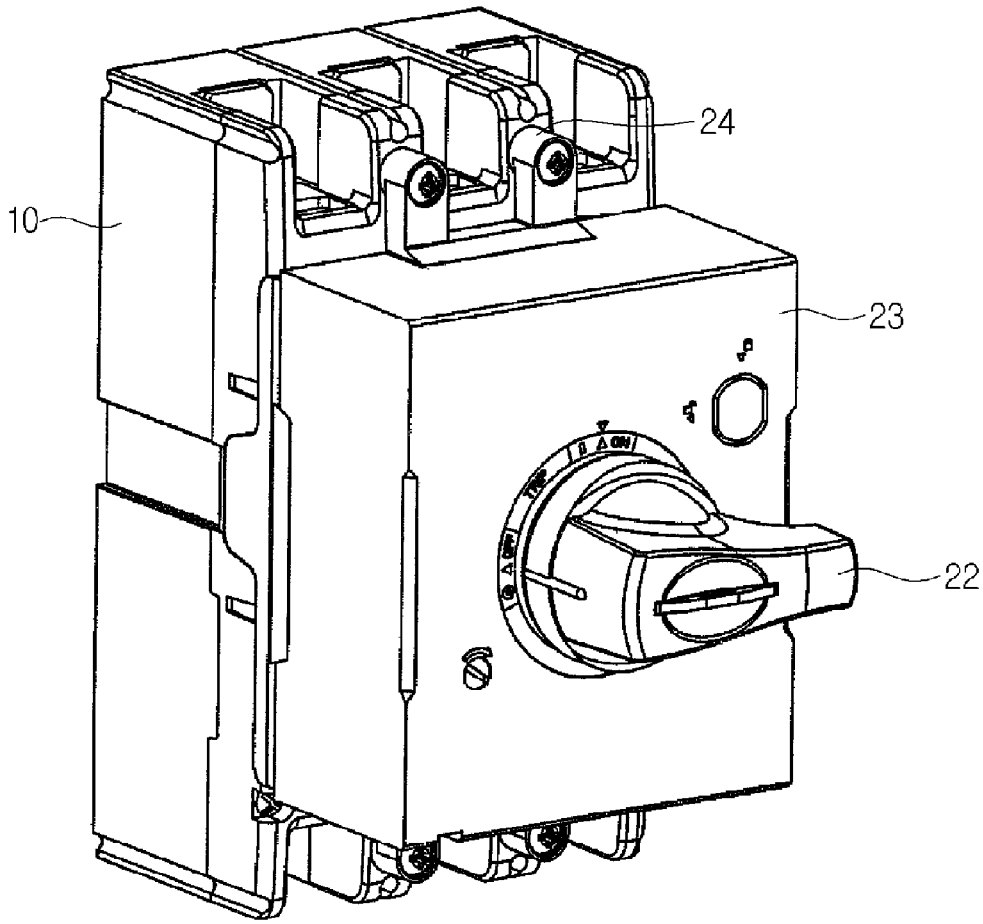
FIG. 3 is a perspective view illustrating an assembled state of the externally operable handle assembly according to the related art.
Figure 4:
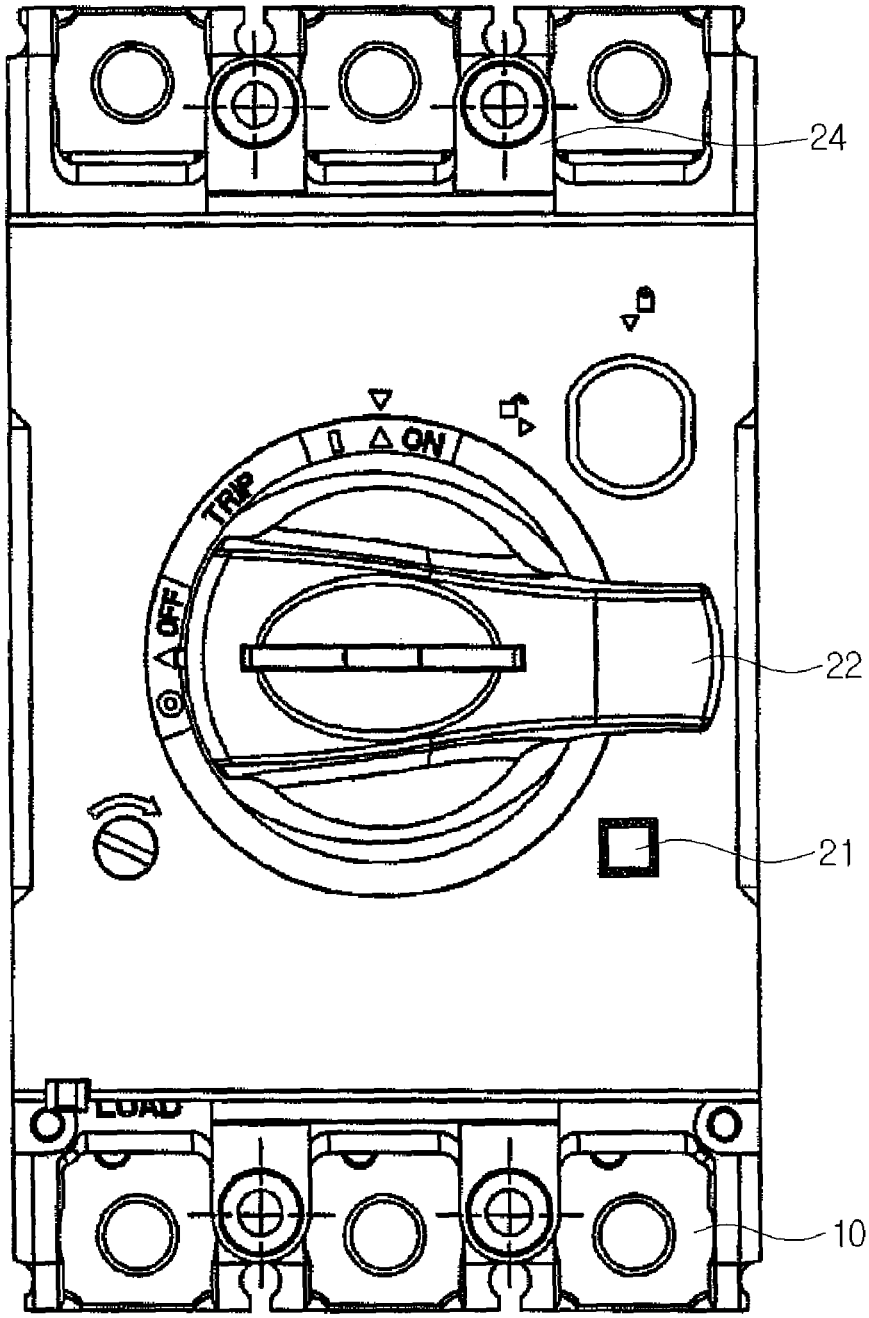
FIG. 4 is a plan view illustrating the assembled state of the externally operable handle assembly according to the related art.
Figure 5:
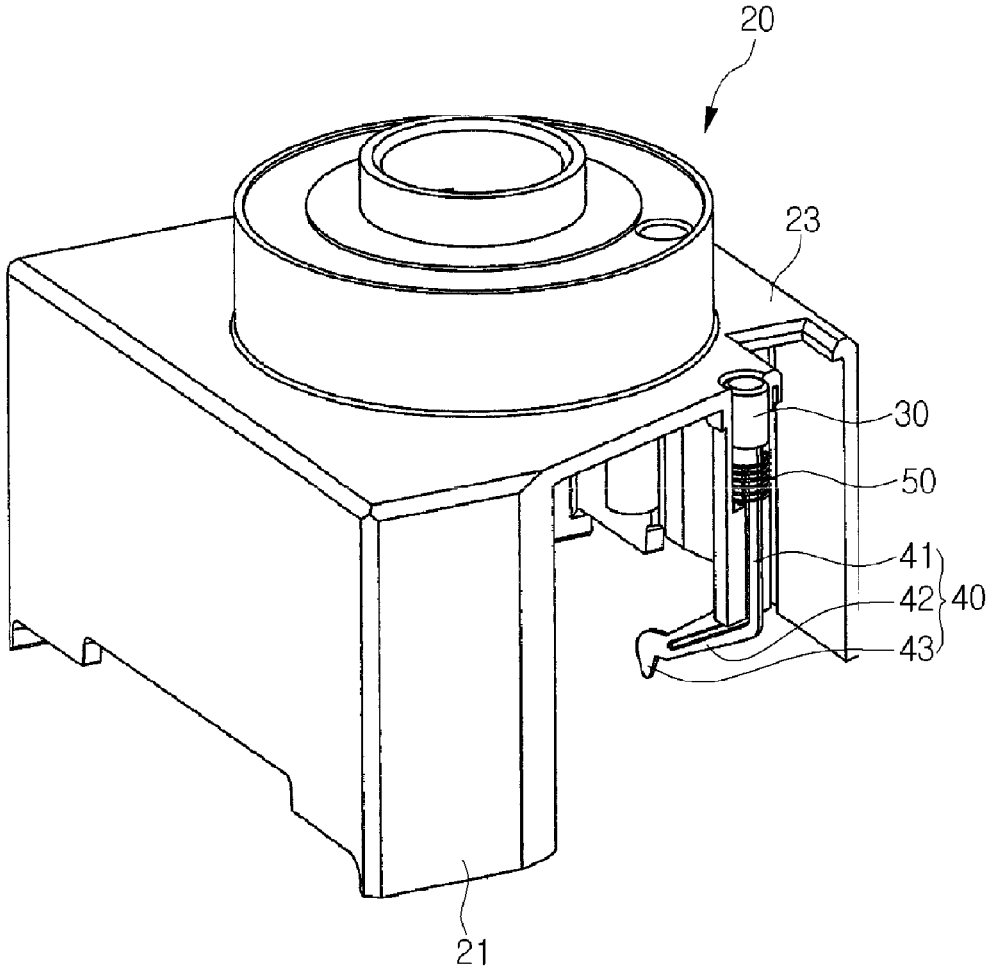
FIG. 5 is a perspective view illustrating an assembly of a pushing plate, an elastic member, and a trip button that is assembled to an outer casing of the externally operable handle assembly according to the related art.
Figure 6:
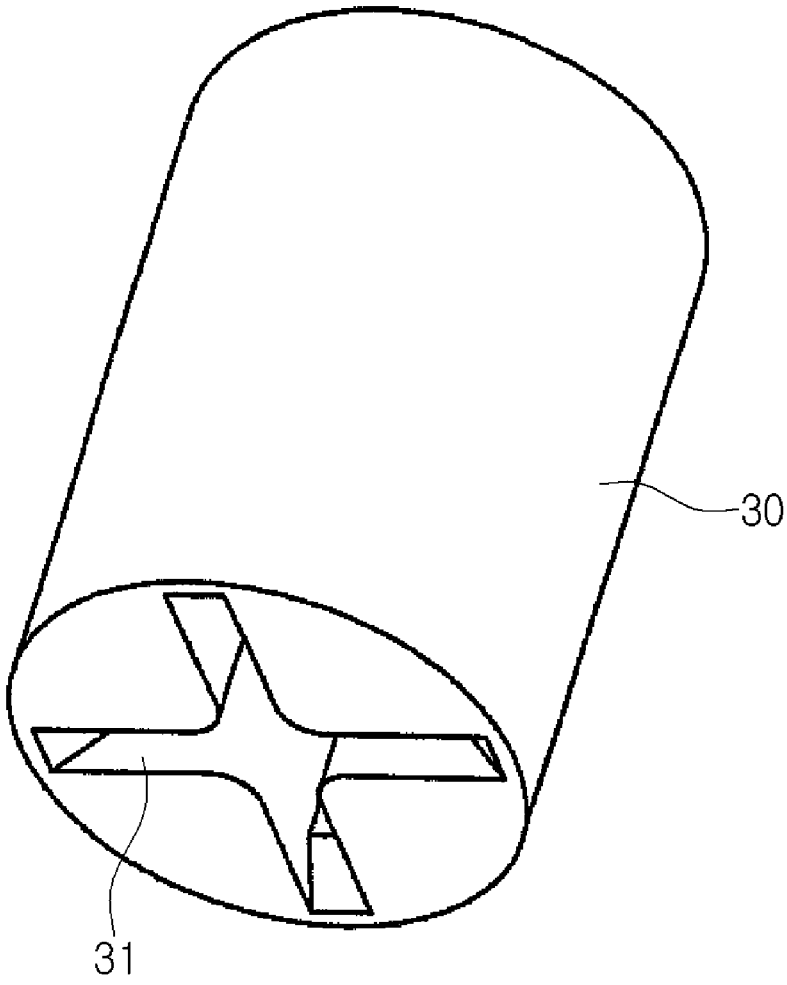
FIG. 6 is a perspective view illustrating an assembled structure of the trip button of the externally operable handle according to the related art.
Figure 7:
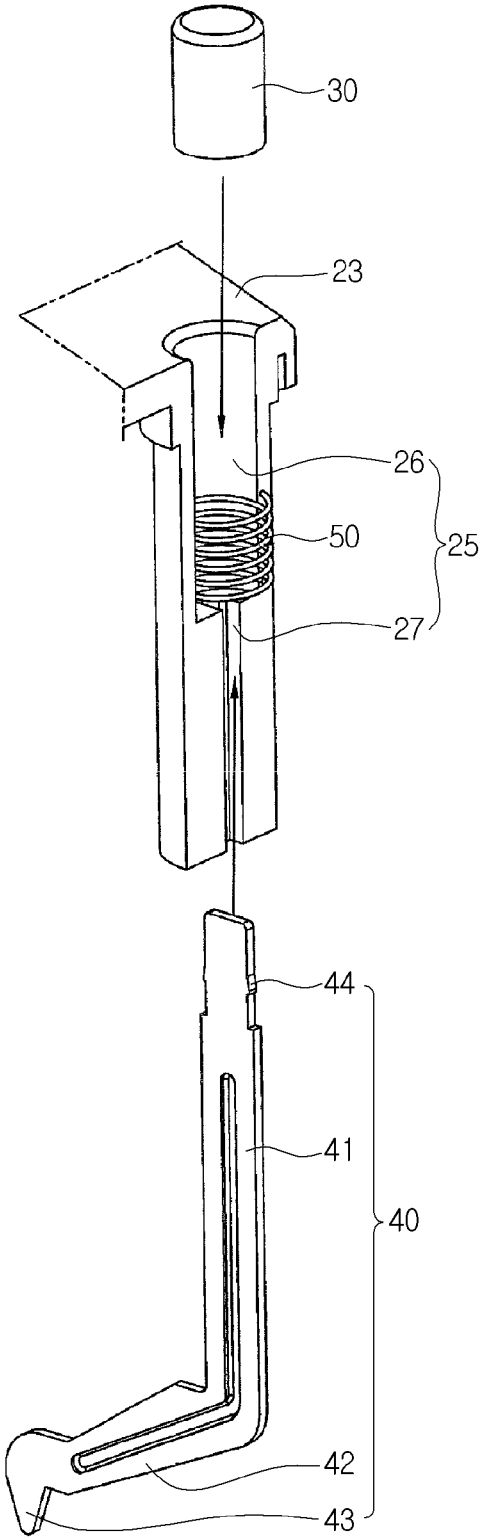
FIG. 7 is an exploded perspective view for explaining a method for assembling the pushing plate, the elastic member, and the trip button according to the related art.
Figure 8:
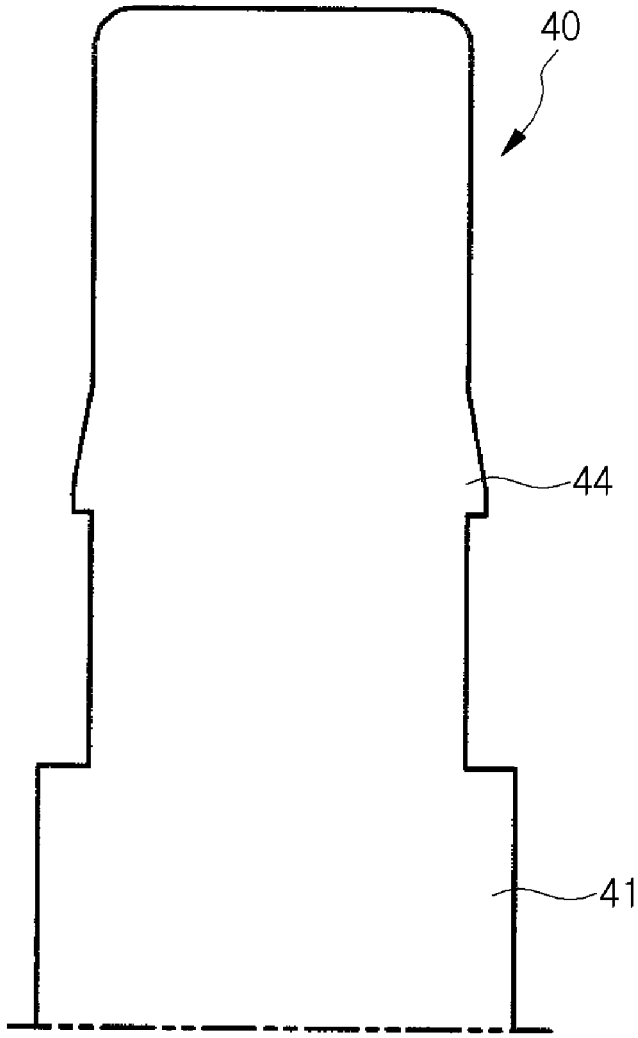
FIG. 8 is an enlarged view illustrating the pushing plate and a fitting protrusion according to the related art.

Referring to FIG. 9, an outer casing 210 forms the exterior of an externally operable handle assembly 200. The externally operable handle assembly 200 includes a trip button mechanism for manipulating the circuit breaker trip button 11 (refer to FIG. 1) from the outside of the externally operable handle assembly 200. The trip button mechanism of the embodiment includes a button support 220, an externally operable trip button 230, and an elastic member 240.

Referring to FIGS. 9 to 11, the button support 220 extends downward from a top surface 211 of the outer casing 210 to an inside region of the outer casing 210. The button support 220 may have a hollow polyhedron shape. In the current embodiment, the button support 220 has an approximately hollow rectangular cylinder shape. However, the shape of the button support 220 is not limited thereto. The button support 220 supports the externally operable trip button 230 in a state where the externally operable trip button 230 is vertically movable.

A top surface of the button support 220 communicates with a penetration hole 212 formed in the top surface 211 of the outer casing 210. An opening 221 is formed through two opposite surfaces of the button support 220. The externally operable trip button 230 and the elastic member 240 are disposed in the opening 221.

First and second spaces 223 and 225 are formed in the button support 220. The first and second spaces 223 and 225 are vertically arranged and communicate with each other. In more detail, the first space 223 communicates with the outside of the outer casing 210 through the penetration hole 212. The first space 223 may have the same shape and size as those of the penetration hole 212. A part (handle 231) of the externally operable trip button 230 is disposed in the first space 223. The handle 231 will be described later. The upper end of the second space 225 communicates with the lower end of the first space 223. Both sides of the second space 225 communicate with the inside of the outer casing 210 through the opening 221. The other part (pusher 233) of the externally operable trip button 230 and the elastic member 240 are disposed in the second space 225. The pusher 233 will be described later. In the current embodiment, the cross-sectional area of the first space 223 is smaller than that of the second space 225.

The button support 220 further includes a first elastic member supporting part 227. The first elastic member supporting part 227 supports the lower end of the elastic member 240 disposed in the second space 225. Substantially, the first elastic member supporting part 227 is disposed in the button support 220 at the bottom of the second space 225.

The externally operable trip button 230 is vertically movable in the button support 220. Referring to FIG. 12, the externally operable trip button 230 includes the handle 231 and the pusher 233. In the current embodiment, the handle 231 and the pusher 233 are formed in one piece. A user may manipulate the externally operable trip button 230 by pushing the handle 231. The handle 231 is disposed in the first space 223. The top surface of the handle 231 is exposed through the top surface 211 of the outer casing 210. That is, the handle 231 is exposed through the penetration hole 212 of the top surface 211. For example, the top surface of the handle 231 may be level with or lower than the top surface 211 of the outer casing 210. This structure may prevent the handle 231 from being pushed against user's intention. Alternatively, a portion of the handle 231 may protrude upward from the top surface 211 of the outer casing 210 through the penetration hole 212. The cross sectional area of the handle 231 may be equal to or smaller than the cross sectional areas of the penetration hole 212 and the first space 223.

A first stopping part 232 is provided at the lower end of the handle 231. The first stopping part 232 regulates movement of the externally operable trip button 230. Substantially, the first stopping part 232 may prevent the handle 231 from being completely separated from the outer casing 210 through the penetration hole 212. For this, the first stopping part 232 has a plate shape and is greater than at least the cross sectional area of the penetration hole 212 and the cross sectional area of the first space 223.

The circuit breaker trip button 11 is substantially pushed by the pusher 233. For this, the pusher 233 is vertically movable in the second space 225 along the button support 220. The pusher 233 includes extension parts 234, a pushing part 235, a second elastic member supporting part 236, and second stopping parts 237.

The extension parts 234 extend downward from the handle 231. That is, substantially, the extension parts 234 extend downward from the lower end of the first stopping part 232. In the current embodiment, the extension parts 234 are two in number and are horizontally spaced from each other. Substantially, the extension parts 234 close the opening 221. This prevents the elastic member 240 from being separated from the second space 225.

The pushing part 235 is provided on the lower end of any one of the extension parts 234. he circuit breaker trip button 11 is substantially pushed by the pushing part 235. he pushing part 235 is disposed outside the second space 225. In the current embodiment, the pushing part 235 extends downward and is reverse L-shaped. However, the shape of the pushing part 235 is not limited thereto.

Substantially, the second stopping parts 237 regulate movement of the pushing pusher 233. he second stopping parts 237 extend outward from outer surfaces of the extension parts 234. Therefore, the second stopping parts 237 are disposed outside the second space 225. If the externally operable trip button 230 is moved upward along the button support 220, the second stopping parts 237 is brought into contact with an upper end of the opening 221. In addition, the second stopping parts 237 function as reinforcement parts for the extension parts 234. Therefore, the second stopping parts 237 may also be referred to as reinforcement parts.

The second elastic member supporting part 236 supports the other end of the elastic member 240. The second elastic member supporting part 236 extends downward from a lower surface of the first stopping part 232. Therefore, when the externally operable trip button 230 is disposed in the second space 225, the first and second elastic member supporting parts 227 and 226 face each other.

The pusher 233 further includes first and second reinforcement parts 238 and 239. The first and second reinforcement parts 238 and 239 increase the strength of the pusher 233. The first and second reinforcement parts 238 and 239 may provided at relatively weak portions. For example, the first and second reinforcement parts 238 and 239 are provided at a connection portion between the pushing part 235 and one of the extension parts 234 and a bent portion of the pushing part 235.

The elastic member 240 exerts an elastic force in a direction opposite to a direction in which the externally operable trip button 230 is moved to manipulate the circuit breaker trip button 11. That is, the externally operable trip button 230 is moved upward in the button support 220 by the resilience of the elastic member 240. For example, the elastic member 240 may be a coil spring. Both ends of the elastic member 240 are supported by the button support 220 and the externally operable trip button 230. In detail, both ends of the elastic member 240 are supported by the first and second elastic member supporting parts 227 and 226.

Hereinafter, an explanation will be given of a method of assembling the trip button mechanism of the externally operable handle for the circuit breaker with reference to the accompanying drawings.

Figure 13:
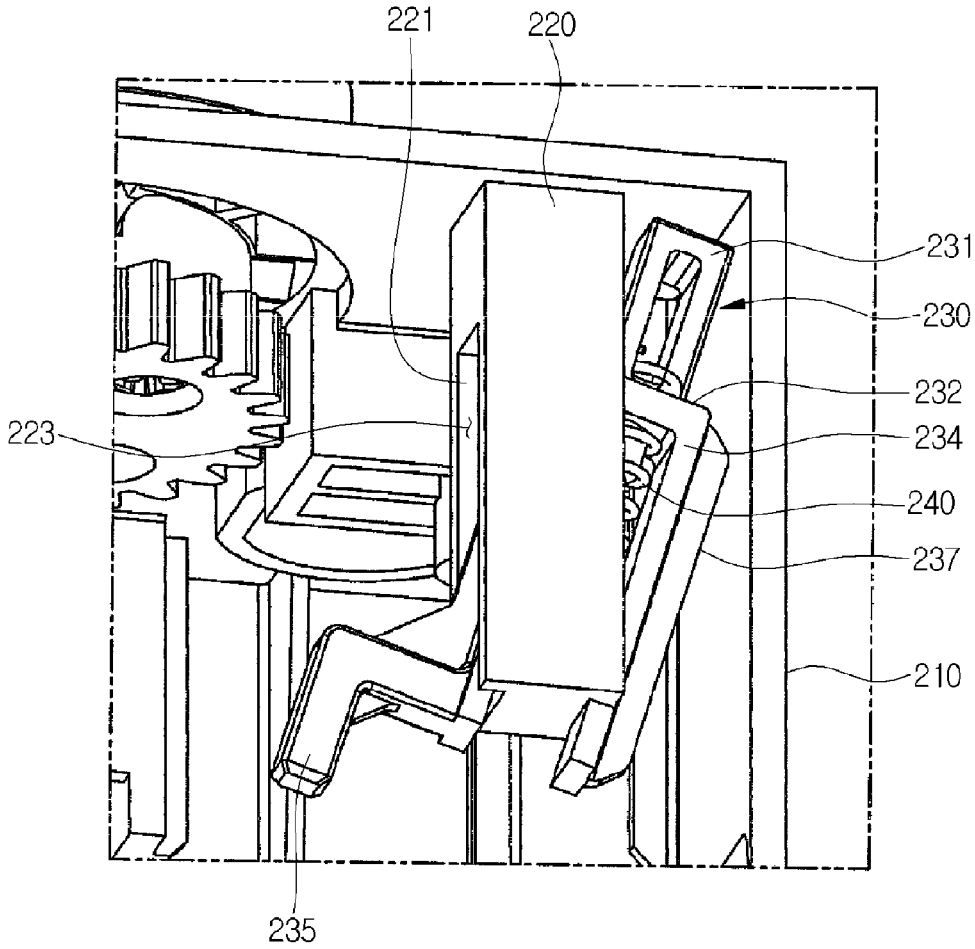
FIGS. 13 to 15 are perspective view for explaining a method for assembling the trip button mechanism according to an embodiment.
Figure 14:
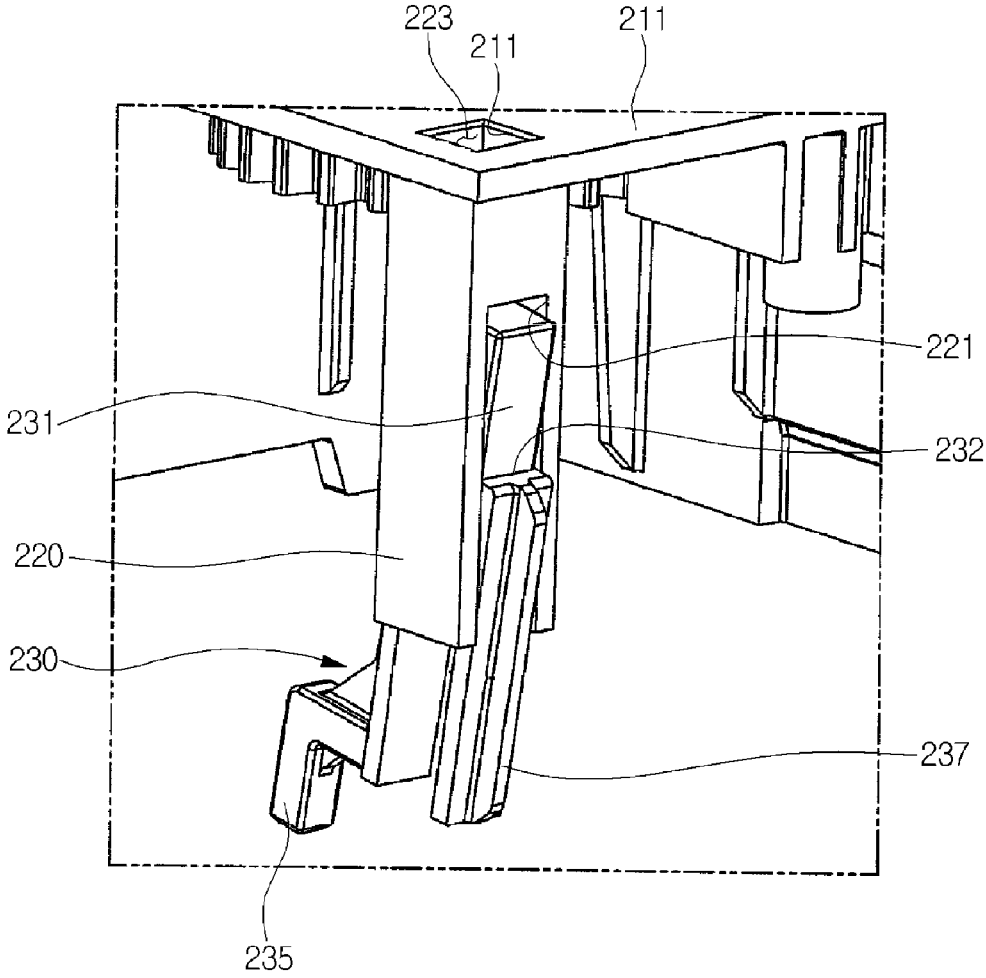
Figure 15:
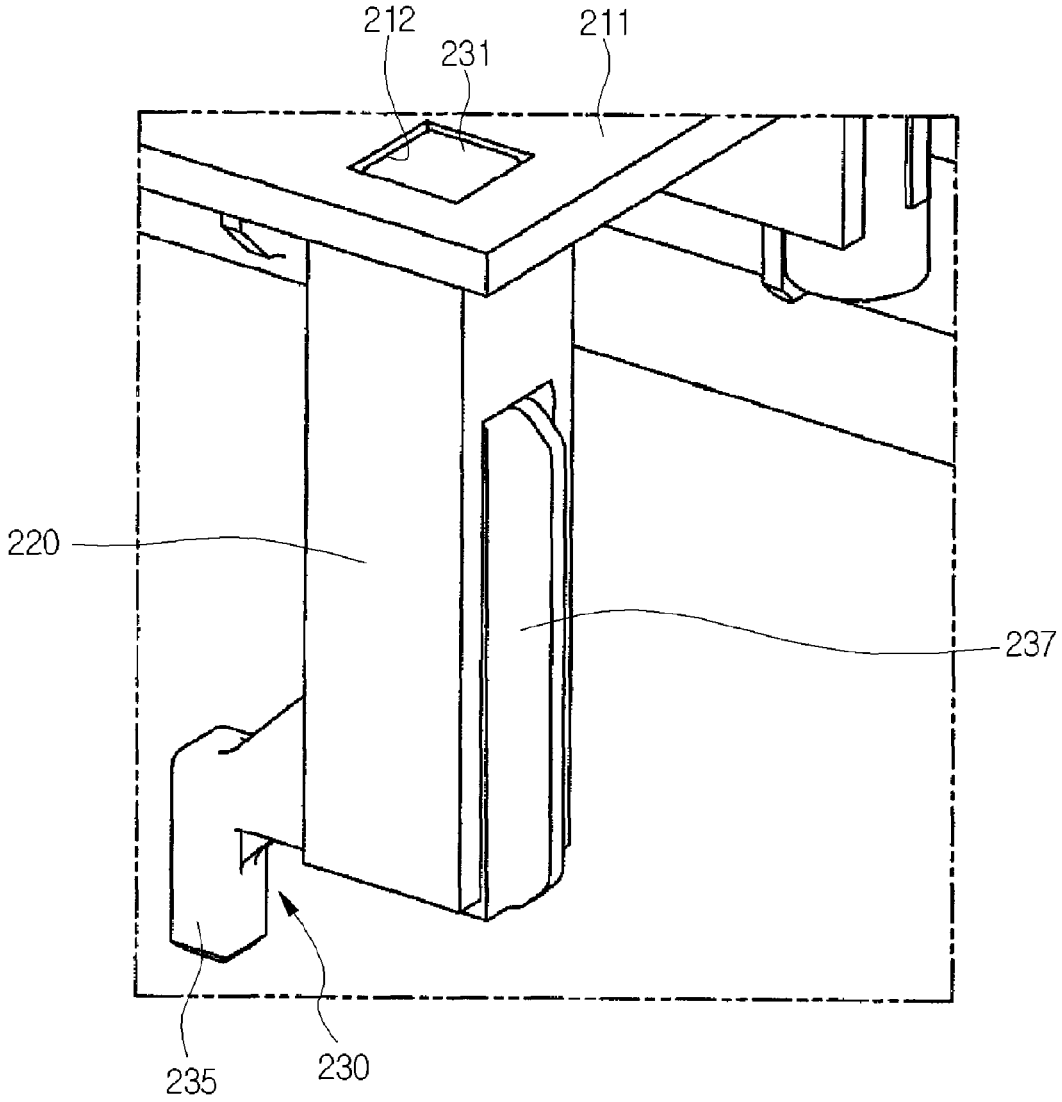

FIGS. 13 to 15 are perspective view for explaining a method for assembling the trip button mechanism according to an embodiment.

First, the externally operable trip button 230 and the elastic member 240 are coupled. In detail, the second elastic member supporting part 236 is inserted in an end of the elastic member 240.

Next, as shown in FIG. 13, the externally operable trip button 230 and the elastic member 240 are placed through the button support 220. Substantially, the externally operable trip button 230 and the elastic member 240 are placed through the opening 221 and make a predetermined angle with the button support 220. At this time, portions of the externally operable trip button 230 (that is, the handle 231 and the pushing part 235) are placed outside the second space 225 through the opening 221. The other portion of the externally operable trip button 230 is placed in the second space 225. In addition, the first elastic member supporting part 227 is inserted in the other end of the elastic member 240 by moving the externally operable trip button 230 and the elastic member 240.

Next, as shown in FIG. 14, the externally operable trip button 230 is moved in a direction where the elastic member 240 is compressed. While the externally operable trip button 230 is moved as described above, if the handle 231 becomes level with the opened side of the button support 220, the externally operable trip button 230 is rotated so that the handle 231 can be placed in the second space 225. For example, the handle 231 may be placed directly under the first space 223.

Then, as shown in FIG. 15, if the externally operable trip button 230 is released, the externally operable trip button 230 is moved upward by the resilience of the elastic member 240. That is, the handle 231 is moved upward in the first space 223. The handle 231 is moved upward until the first and second stopping parts 232 and 237 are brought into contact with the top surface of the second space 225 or the upper end of the opening 221. Then, the top surface of the handle 231 is exposed through the penetration hole 212.

When the externally operable trip button 230 is placed in the button support 220, the opening 221 of the button support 220 is substantially closed by the extension parts 234 of the externally operable trip button 230. Therefore, when the externally operable trip button 230 is placed in the button support 220, the elastic member 240 may not be separated from the button support 220.

An explanation will be given of an exemplary operation of the trip button mechanism of the externally operable handle for the circuit breaker according to an embodiment.

First, to forcibly trip the circuit breaker 10, the externally operable trip button 230 (that is, the handle 231) is pushed, and then the externally operable trip button 230 is moved downward along the button support 220. At this time, the externally operable trip button 230 is pushed against the resilience of the elastic member 240.

As the externally operable trip button 230 is moved downward along the button support 220, the circuit breaker trip button 11 is pushed by the externally operable trip button 230 (that is, the pusher 233). As the circuit breaker trip button 11 is pushed, the internal opening/closing mechanism (not shown) of the circuit breaker 10 is operated, and thus a movable contact (not shown) is separated from a fixed contact (not shown). In this way, a circuit is forcibly interrupted by forcible tripping.

As described above, the opening 221 of the button support 220 is closed by the extension parts 234 of the externally operable trip button 230. Therefore, when a user manipulates the externally operable trip button 230, the elastic member 240 may not be separated from the button support 220.

As described above, in the trip button mechanism of the embodiments, the handle for a user and the pusher for pushing the circuit breaker trip button are formed in one piece. Therefore, the trip button mechanism can be easily assembled and reliably operated. In addition, since the trip button mechanism has fewer components, the trip button mechanism can be manufactured with high productivity and low costs.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

In the above-described embodiments, the first and second stopping parts 232 and 237 are used to regulate movement of the externally operable trip button 230. However, only one of the first and second stopping parts 232 and 237 may be used.

What is claimed is:

1. A trip button mechanism of an externally operable handle, the trip button mechanism for operating a circuit breaker trip button of a circuit breaker and comprising:

a button support located at an outer casing of the externally operable handle, the button support exposed through a penetration hole of the outer casing;

an externally operable trip button comprising:

the externally operable handle exposed through the penetration hole;

a pusher formed in one piece with the handle, the pusher movable along the button support for selectively pushing the circuit breaker trip button; and a pair of extension parts spaced from each other; and an elastic member for applying an elastic force to the externally operable trip button in a direction opposite to a direction in which the pusher pushes the circuit breaker trip button, wherein the button support has a hollow polyhedron shape, wherein two opposite sides of the button support are opened for locating the externally operable trip button and the elastic member, wherein the two opposite sides of the button support are closed by the pair of extension parts, and wherein the elastic member is located between the pair of extension parts.

2. The trip button mechanism according to claim 1, wherein one end of the elastic member is supported by the button support and another end of the elastic member is supported by the externally operable trip button.

3. The trip button mechanism according to claim 1, wherein the handle has a cross-section that is smaller than a cross-section of the pusher.

4. The trip button mechanism according to claim 1, wherein at least a portion of the pusher is located outside the button support for selectively pushing the circuit breaker trip button.

5. A trip button mechanism of an externally operable handle, the trip button mechanism for operating a circuit breaker trip button of a circuit breaker and comprising:

a button support located at an outer casing of the externally operable handle, the button support comprising a space formed therein and an opening formed through at least portions of two mutually facing sides of the button support wherein the space facilitates communication external the mechanism via the opening and a penetration hole of the outer casing;

an externally operable trip button located at the button support, the externally operable trip button comprising the externally operable handle and a pusher formed in one piece, the pusher for pushing the circuit breaker trip button; and an elastic member for applying an elastic force to the externally operable trip button in a direction opposite to a direction in which the pusher pushes the circuit breaker trip button, wherein the externally operable trip button is located in the button support, wherein the externally operable trip button further comprises a pair of extension parts spaced from each other to cover the opening of the button support, and wherein the elastic member is located between the pair of extension parts.

6. The trip button mechanism according to claim 5, wherein the handle is exposed through the penetration hole.

7. The trip button mechanism according to claim 5, wherein the externally operable trip button and the elastic member are located in the button support via the opening.

8. The trip button mechanism according to claim 5, wherein the space comprises:

a first space in which the handle is placed, the first space facilitating communication external to the outer casing via the penetration hole; and a second space communicating with the first space in a vertical direction, the second space facilitating communication internal to the outer casing via the opening, wherein a portion of the pusher is located in the second space.

9. The trip button mechanism according to claim 8, wherein the first space has a cross-sectional area smaller than a cross-sectional area of the second space.

10. A trip button mechanism of an externally operable handle, the trip button mechanism for operating a circuit breaker trip button of a circuit breaker and comprising:

a button support located at an outer casing of the externally operable handle, the button support comprising an opening formed through two mutually facing sides of the button support;

an externally operable trip button located in the button support for manipulating the circuit breaker trip button, the externally operable trip button comprising a pair of extension parts spaced from each other; and an elastic member for applying an elastic force in a direction opposite to a direction in which the externally operable trip button pushes the circuit breaker trip button, wherein the externally operable trip button and the elastic member are located in the button support via the opening, wherein the opening is closed by the pair of extension parts, and wherein the elastic member is located between the pair of extension parts.

11. The trip button mechanism according to claim 10, wherein the externally operable trip button further comprises:

the externally operable handle; and a pusher formed in one piece with the externally operable handle for pushing the circuit breaker trip button.

12. The trip button mechanism according to claim 11, wherein the externally operable handle is exposed via a penetration hole formed in the outer casing.

13. The trip button mechanism according to claim 12, wherein a stopping part is located between the externally operable handle and the pusher for preventing the externally operable trip button from being completely separated from the outer casing through the penetration hole.

14. The trip button mechanism according to claim 11, wherein the pusher comprises:

the pair of extension parts extending from a bottom surface of the handle; and a pushing part extending from a lower end of the pair of extension parts for pushing the circuit breaker trip button.

15. The trip button mechanism according to claim 14, wherein a stopping part is located on an outer surface of the pair of extension parts for regulating movement of the externally operable trip button by selectively making contact with a side of the opening.

* * * * *